US012523439B2

(12) United States Patent
Bray et al.

(10) Patent No.: US 12,523,439 B2
(45) Date of Patent: Jan. 13, 2026

(54) FIREARM SUPPRESSOR

(71) Applicant: Polaris Capital LLC, Orem, UT (US)

(72) Inventors: Ernest R. Bray, American Fork, UT (US); David S. Clark, Eagle Mountain, UT (US)

(73) Assignee: Polaris Capital Corporation, Orem, UT (US)

( * ) Notice: Subject to any disclaimer, the term of this patent is extended or adjusted under 35 U.S.C. 154(b) by 604 days.

(21) Appl. No.: 17/270,559

(22) PCT Filed: Jan. 27, 2020

(86) PCT No.: PCT/US2020/015270
§ 371 (c)(1),
(2) Date: Feb. 23, 2021

(87) PCT Pub. No.: WO2020/176182
PCT Pub. Date: Sep. 3, 2020

(65) Prior Publication Data

US 2021/0180902 A1 Jun. 17, 2021

Related U.S. Application Data

(60) Provisional application No. 62/796,016, filed on Jan. 23, 2019.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/325; F01N 1/12; F01N 1/088
(Continued)

(56) References Cited

U.S. PATENT DOCUMENTS 2,375,617 A 5/1945 Bourne
2,841,235 A * 7/1958 Curioni ..... F01N 1/12 181/280
(Continued)

FOREIGN PATENT DOCUMENTS

RU 2397422 C1 * 8/2010

OTHER PUBLICATIONS

Machine Translation of RU-2397422-C1 (Year: 2010).*
(Continued)

*Primary Examiner* — Forrest M Phillips
*Assistant Examiner* — Jennifer B Olson
(74) *Attorney, Agent, or Firm* — Kunzler Bean & Adamson

(57) ABSTRACT

A firearm suppressor (100) is disclosed that includes a plurality of fluid redirectors (202). The fluid redirectors (202) include vanes (402) in one of either a clockwise or counterclockwise configuration. The firearm suppressor (100) also includes an outer tube (102) disposed around the plurality of fluid redirectors (202). The fluid redirectors (202) are stackable and include an annular base (404) that tapers to a central opening (406), where the central opening (406) is configured to receive a projectile. Each vane (402) is configured to nest into the annular base (404) of a first adjacent stackable fluid redirector (202). A firearm is also disclosed and includes a barrel (1402) and the firearm suppressor (100).

19 Claims, 20 Drawing Sheets

(58) Field of Classification Search
USPC ..... 181/223; D22/108
See application file for complete search history.

(56) References Cited

U.S. PATENT DOCUMENTS

| | | | | |
|---|---|---|---|---|
| 5,164,535 | A | 11/1992 | Leasure | |
| 7,073,626 | B2 * | 7/2006 | Weinhold | F01N 1/088 181/269 |
| 7,987,944 | B1 | 8/2011 | Brittingham | |
| 8,210,087 | B2 | 7/2012 | Latka | |
| 8,522,662 | B2 | 9/2013 | Presz, Jr. | |
| 8,844,422 | B1 * | 9/2014 | Klett | F41A 21/34 89/14.4 |
| D728,058 | S * | 4/2015 | Cheney | D22/108 |
| 9,423,198 | B1 * | 8/2016 | Oliver | F41A 21/30 |
| 9,482,484 | B2 | 11/2016 | Barney | |
| 10,113,826 | B2 * | 10/2018 | Bray | F41A 21/34 |
| 10,267,586 | B1 * | 4/2019 | Marfione | F41A 21/30 |
| 11,480,405 | B2 * | 10/2022 | Bender | F41A 21/30 |
| 2014/0076658 | A1 | 3/2014 | Smith, II | |
| 2014/0299405 | A1 | 10/2014 | Miller | |
| 2017/0102202 | A1 * | 4/2017 | Augustine | F41A 21/30 |
| 2017/0205174 | A1 * | 7/2017 | Petersen | F41A 21/30 |
| 2018/0135932 | A1 * | 5/2018 | Tomczak | F41A 21/30 |
| 2018/0347932 | A1 | 12/2018 | Bray | |
| 2019/0257607 | A1 * | 8/2019 | Dobrinescu | F41A 21/30 |
| 2020/0173751 | A1 * | 6/2020 | Dorne | F41A 21/30 |
| 2021/0018287 | A1 * | 1/2021 | Kada | F41A 21/30 |

OTHER PUBLICATIONS

"Notification of transmittal of the international search report and the written opinion of the International searching authority or the declaration", ISA, Aug. 11, 2020, pp. 1-11.

* cited by examiner

FIREARM SUPPRESSOR

CROSS-REFERENCES TO RELATED APPLICATIONS

This application claims the benefit of U.S. Provisional Patent Application No. 62/796,016 entitled "FIREARM SUPPRESSOR" and filed on Jan. 23, 2019 for Ernest R. Bray, which is incorporated herein by reference.

FIELD

This invention relates to firearms, and more particularly relates to firearm suppressors.

BACKGROUND

Suppressor design has, for over 100 years, included the basic structure of a series of baffles and chambers which trap expanding gasses as they exit a muzzle. Though there have been many variations on this core design concept, virtually every design has followed this basic design. However, this basic design is flawed because it traps the pressure in the initial chamber and significant pressure is generated on the first baffle, commonly called the "blast baffle". This pressure and heat buildup in that first chamber creates several negative effects that include back pressure into the barrel. This back pressure often causes the firearm to malfunction from added carbon and fouling from the gasses. Additionally, over gassing the system and increasing the cyclic rate creates additional stresses on the components that lead to mechanical failures. Another negative effect of excessive backpressure is that gasses and debris are blown back into the operator's face. The other shortcomings of the basic design are that the gasses must exit out of the small holes either back into the barrel, or forward against the base of the bullet, which can cause turbulence and accuracy issues.

SUMMARY

An apparatus for firearm suppressor is disclosed. The firearm suppressor includes, in certain examples, a plurality of fluid redirectors, each of the plurality of fluid redirectors comprising vanes in one of either a clockwise or counterclockwise configuration. The firearm suppressor also includes an outer tube disposed around the plurality of fluid redirectors.

In certain examples, the firearm suppressor also includes a baffle sleeve disposed between the outer tube and the plurality of fluid redirectors. The baffle sleeve includes at least one uninterrupted fluid pathway extending along the exterior surface of the baffle sleeve and formed by interdigitated baffle ridges. In certain examples, each fluid redirector includes an annular base that tapers to an opening in a center of the annular base, the annular base forming a substantially conical shape, a locating tab extending from at least one of the vanes, and at least one positioning notch formed in the annular base and configured to receive a locating tab of an adjacent fluid redirector.

The firearm suppressor of claim 4, where the vanes of each of the plurality of fluid redirectors are configured to nest into the opening of the annular base of the adjacent one of the plurality of fluid redirectors. The firearm suppressor also includes an alignment tube. The alignment tube has a tubular shaft having a first end and a second end, and a fluid redirector integrally formed with the tubular shaft disposed adjacent the first end.

In certain examples, the firearm suppressor includes a baffle disc slidably coupled to a tubular shaft of an alignment tube. The baffle disc may include a central opening configured to engage the tubular shaft of the alignment tube, and a plurality of vanes extending outward from the baffle disc. Each of the plurality of vanes of the baffle disc may include a shoulder for receiving and locating a washer.

A firearm is also disclosed. The firearm includes a barrel that is configured to couple to the firearm suppressor.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

The subject matter of the present application has been developed in response to the present state of the art, and in particular, in response to the problems and needs in the art that have not yet been fully solved by currently available firearm suppressors. Accordingly, the subject matter of the present application has been developed to provide a firearm suppressor that overcomes at least some shortcomings of the prior art.

The description of elements in each figure may refer to elements of proceeding figures. Like numbers refer to like elements in all figures, including alternate embodiments of like elements. Similar elements may be referred to with a number and a letter, such as "102*a*" and "102*b*", when identified individually, and when referred to jointly by the number only (i.e., "102" without that "a" or "b").

Figure 1:
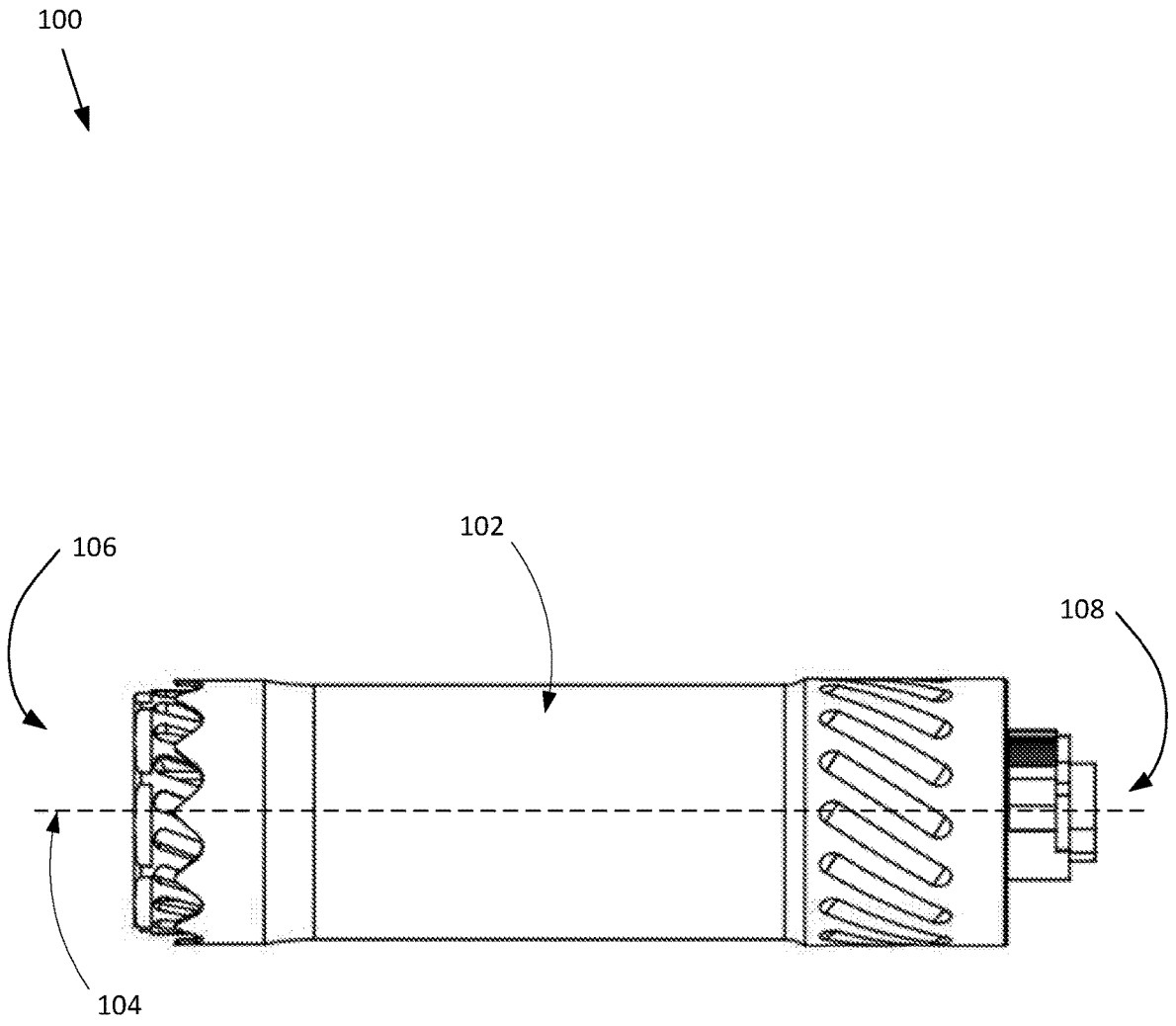
FIG. 1 is a side-view diagram illustrating one embodiment of a firearm suppressor in accordance with embodiments of the present disclosure.

FIG. 1 is a side-view diagram illustrating one embodiment of a firearm suppressor 100 in accordance with embodiments of the present disclosure. Although the below described embodiments describe the use of the suppressor 100 in use with a rifle, the components and methods described may be modified to accommodate different types of firearms, including but not limited to, pistols, shotguns, etc.

The suppressor 100 is formed of multiple individual components that may be separately manufactured and assembled to form the suppressor 100. However, the suppressor 100 may alternatively be manufactured as a single unitary product. It is contemplated that as 3D printing techniques improve, the suppressor 100 may be manufactured by these 3D printing techniques. Generally, the suppressor 100 is formed of metals and/or metallic alloys. Different materials may be used for the different components, as it may be desirable for one component to absorb and diffuse heat, and thereby have a high coefficient of thermal conductivity, and another component to have a low coefficient of thermal conductivity.

In one embodiment, the suppressor 100 is formed with an outer tube 102 that forms a housing around the multiple components that will be described below in greater detail. Generally, each of the components is formed having a bore that extends from a first end 108 to a second end 106. In other words, many of the components of the suppressor 100 are formed with a passageway through which a projectile may pass. The suppressor 100 has a longitudinal axis (depicted by line 104) that extends from a longitudinal axis of a firearm barrel. The longitudinal axis coincides with a path that the projectile will travel from the barrel towards a second end 106 or outlet of the suppressor 100. The suppressor 100 is formed with an inlet 108 that engages the muzzle end of the barrel to receive a bullet, or other high energy (i.e., high velocity) projectile, and an outlet 106 through which the bullet travels and for exhausting and dissipating muzzle blast, bullet shock waves, and other particulates.

Figure 2:
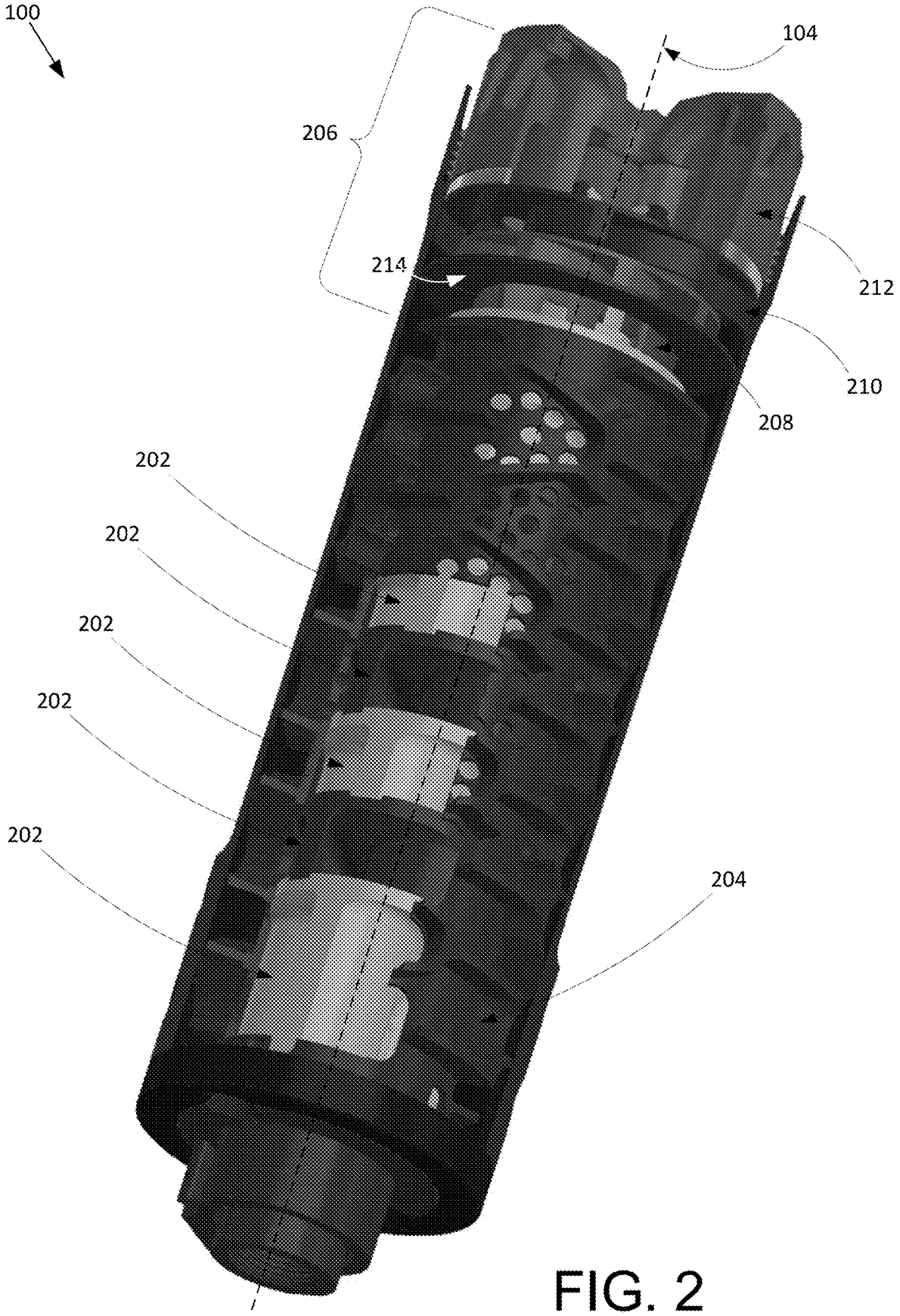
FIG. 2 is a perspective view diagram illustrating a section view of the suppressor in accordance with embodiments of the present disclosure.

FIG. 2 is a perspective view diagram illustrating a section view of the suppressor 100 in accordance with embodiments of the present disclosure. In the depicted embodiment, the suppressor 100 includes one or more flow redirectors 202 disposed within a baffle sleeve 204. Coupled to an end of the baffle sleeve 204 is an alignment tube (not shown here) that supports the components of the flash mitigation cap 206, which include a first baffle disc 208, a second baffle disc 210, and an end cap 212. In an additional embodiment, a blocking disc 214 may be disposed on the first baffle disc 208 and configured to route gasses inward towards the longitudinal axis 104 of the bore of the suppressor 100. Each of these components will be described in greater detail below with reference to FIGS. 3-11.

Figure 3:
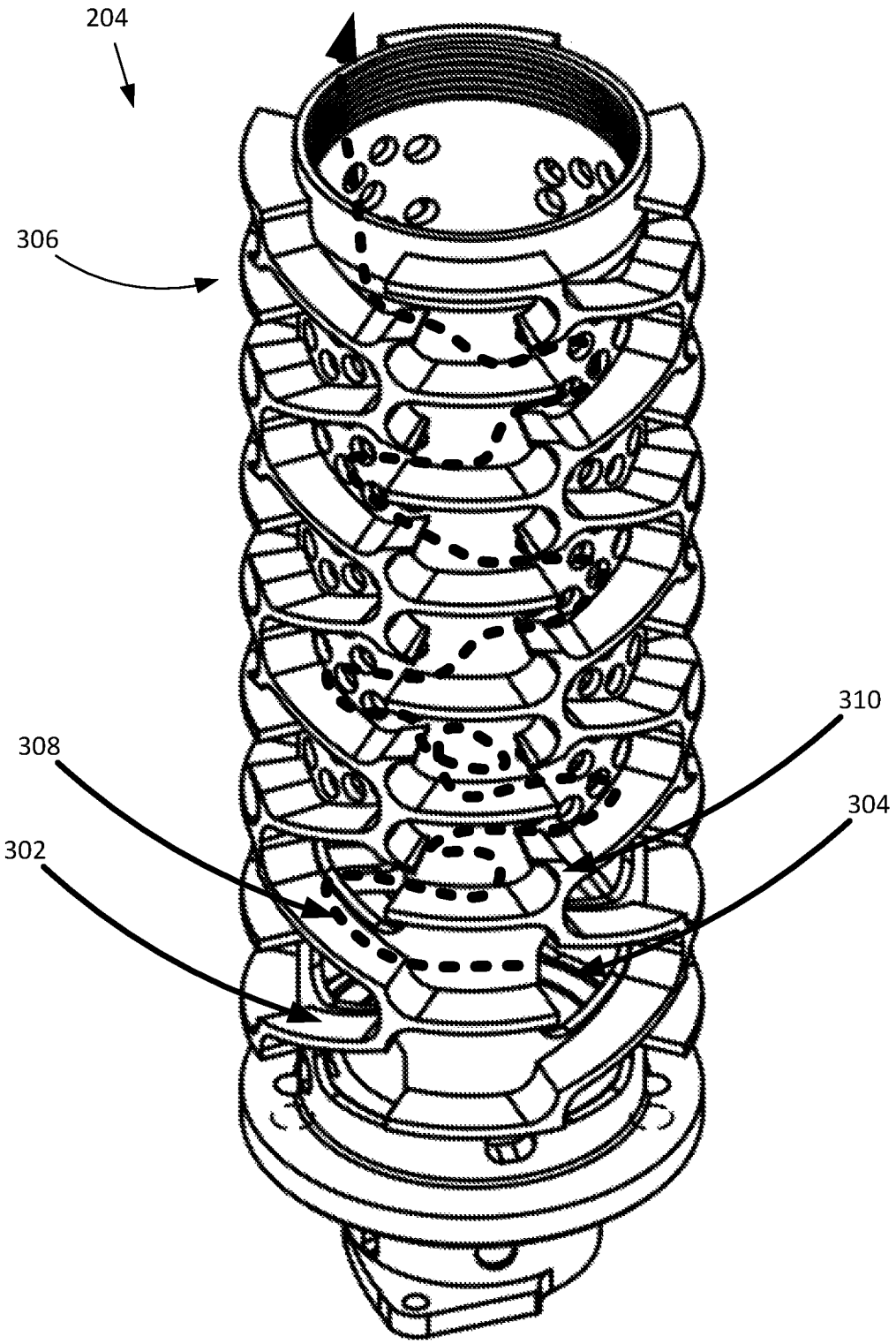
FIG. 3 is a perspective view diagram illustrating one embodiment of the baffle sleeve in accordance with embodiments of the present disclosure.

FIG. 3 is a perspective view diagram illustrating one embodiment of the baffle sleeve 204 in accordance with embodiments of the present disclosure. The baffle sleeve 204 is configured with an inner diameter that is selected to be larger than an outer diameter of the flow redirectors 202 so that one or more flow redirectors 202 are insertable into the baffle sleeve 204. The baffle sleeve 204, in one embodiment, is formed with at least one uninterrupted fluid pathway extending in a generally longitudinal manner from one end of the baffle sleeve to another end. Stated differently, a fluid pathway is formed between baffles 302 (or ridges), an outer surface of the baffle sleeve 204, and the outer tube 102. Each fluid pathway may "snake" along the exterior of the baffle sleeve 204 between a series of baffles 302 from one end of the baffle sleeve 204 to the second end. As used herein, the phrase "uninterrupted fluid pathway" refers to a fluid pathway on the exterior surface of the baffle sleeve 204 that is not completely blocked by a baffle 302 or other wall. Accordingly, gasses that enter a first opening 304, after passing through a flow redirector 202, adjacent a first end of the baffle sleeve 204 may proceed along the exterior surface of the baffle sleeve 204 to a second opening 306 adjacent the second end of the baffle sleeve 204, as depicted by dotted line 308. The first opening 304 may be aligned with a discharge port of a flow redirector 202.

In the depicted embodiment, the baffles 302 on either side of the fluid pathway 308 extend towards each other in an interdigitated manner to create a zig-zag type pattern. The baffles 302, as depicted, may be formed in repeating and interdigitated geometric shapes such as partial hexagons (i.e., V or U-shaped baffles), or alternatively, may be formed in a more organic and/or random fashion, as long as the fluid pathway 308 is uninterrupted along the exterior surface of the baffle sleeve 204. In one embodiment, baffles 302 may include "hooks" that turn the fluid flow back on itself. In the depicted embodiment, a hook 310 causes a disturbance in the fluid flow that slows down the exhaust gasses.

Two or more interdigitated fluid pathways may be formed on the exterior surface of the baffle sleeve 204. In an alternative embodiment, a single fluid pathway may be formed that snakes back and forth across the exterior surface of the baffle sleeve. In other words, the fluid pathway 308 may be laterally serpentine along a longitudinal axis, with the turns of the fluid pathway 308 interdigitating with an adjacent fluid pathway. For example, the fluid primarily flows laterally (i.e., the fluid travels a greater distance from side to side, than longitudinally towards the end of the suppressor) along the exterior surface of the baffle sleeve.

Openings 306 formed in the fluid pathway 308 allow gas to flow between the bore and the outer chamber formed by the baffle sleeve 204 and outer tube 102. This prevents a buildup of pressure as the projectile/bullet passes through the flow redirectors 202.

As the gasses exit the flow redirectors 202 into the outer chamber formed by the baffle sleeve 204 and the outer tube 102, the shape of the baffles 302 redirects the gasses down at least one fluid pathway. In other embodiments, the baffles 302 redirect gasses into two or more directions in the same fluid pathway 308.

Beneficially, as the bullet/projectile passes from one flow redirector 202 to an adjacent flow redirector 202, the venting gasses are directed outward into the baffle sleeve 204 in opposing directions (i.e., right-hand spin and left-hand spin) to accomplish pressure equalization. In other words, the design of the interdigitated baffles causes adjacent openings to exhaust gasses into different fluid pathways. Every other flow redirector 202 opening exhausts into the same fluid pathway, as depicted. Alternatively, a design may be contemplated that exhausts adjacent, or every third, for example, port into the same fluid pathway.

Ports 304 in the baffle sleeve 204 are positioned to coordinate (or align with) the exhaust openings in the flow redirectors 202. Additional openings, which may be smaller, allow gasses to expand back into the flow redirectors 202. The sequencing of the expansion ports creates a rearward flow of gasses in the cutouts in the baffle sleeve 204 allow those gasses to flow back up into the baffle sleeve. As pressures equalizes gasses can flow back and forth between the outer chamber and the flow redirectors 202, further cooling and slowing the gasses. The baffle sleeve 204 also provides slowing, cooling, and expansion of the gasses.

Figure 4A:
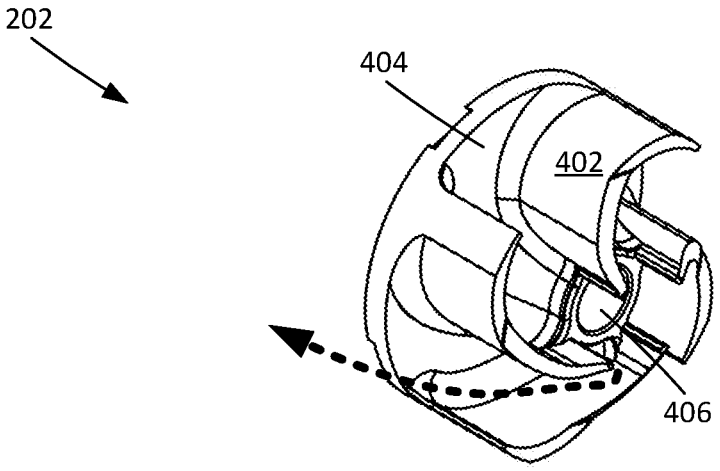
FIGS. 4*a* and 4*b* are perspective view diagrams illustrating embodiments of flow redirectors in accordance with embodiments of the present disclosure.
Figure 4B:
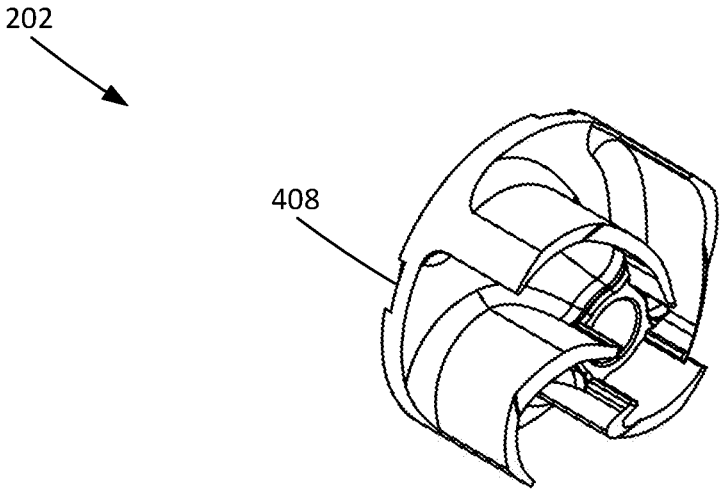

FIGS. 4*a* and 4*b* are perspective view diagrams illustrating embodiments of flow redirectors 202 in accordance with embodiments of the present disclosure. Each of the flow redirectors may be configured to exhaust gasses in a different rotational direction. The flow redirectors 202 resemble radial-flow, semi-open impellers with vanes 402 free on one side and enclosed on another side by a shroud 404. An opening 406 may be formed in the center of each flow redirector 202, that forms part of the bore through which the projectile passes. As the projectile passes each flow redirector 202, gasses may be expelled outward between the vanes 402 in a radial direction, as indicated by the dashed arrow. Adjacent vanes 402 form an exhaust port through which gasses exit, as depicted, because the vanes 402 have a greater height than the shroud 404. When flow redirectors 202 are nested (i.e., stacked) the flow redirectors 202 function in a manner similar to a closed impeller with the vanes 402 enclosed on each side. Stated differently, when stacked, a vane 402 extends outward from, and is continuous with, the shroud 404, and is therefore enclosed on one side by the shroud 404, and on the other side by the shroud 404 of the adjacent flow redirector 202 (see FIG. 9).

In certain embodiments, the suppressor 100 is provided with alternating direction flow redirectors 202. In the depicted embodiments, the flow redirectors 202 may be configured to exhaust gasses in a clockwise direction (see FIG. 4*a*) or a counterclockwise direction (see FIG. 4*b*). This, beneficially, allows for the balancing or rotational torque forces that may occur due to the exhausting of the gasses. In other examples, flow redirectors 202 of the same flow direction may be stacked. Any combination of flow redirectors is contemplated, including but not limited to, all clockwise, all counter-clockwise, a pair of clockwise adjacent a pair of counter-clockwise, repeating patterns of clockwise mixed with counter-clockwise, and non-repeating patterns of clockwise mixed with counter-clockwise.

As described above, the flow redirectors 202 are configured to nest into another flow redirector 202. The vanes 402 of a single flow redirector 202 have a semi-conical shape (i.e., when viewed from the side, with the shroud 404 sitting on a horizontal surface, the vanes 402 appear to have an increasing height with reference to the horizontal surface) that is configured to engage a concave surface of an adjacent shroud 404 (the opposite surface of the convex shroud 404 surface depicted in FIGS. 4*a* and 4*b*). A notch 408 may be formed in the concave surface of the shroud 404 and configured to receive a top surface of a vane 402 of the adjacent flow redirector 202. This, beneficially, rotationally fixes the position of each flow redirector 202 with respect to the adjacent flow redirectors 202.

In one embodiment, the opening 406 of the flow redirector 202 does not contact the concave surface of an adjacent flow redirector 202. This allows for a gap to exist between adjacent flow redirectors 202 through which exhaust gasses may escape the bore formed by the flow redirectors 202.

Figure 5:
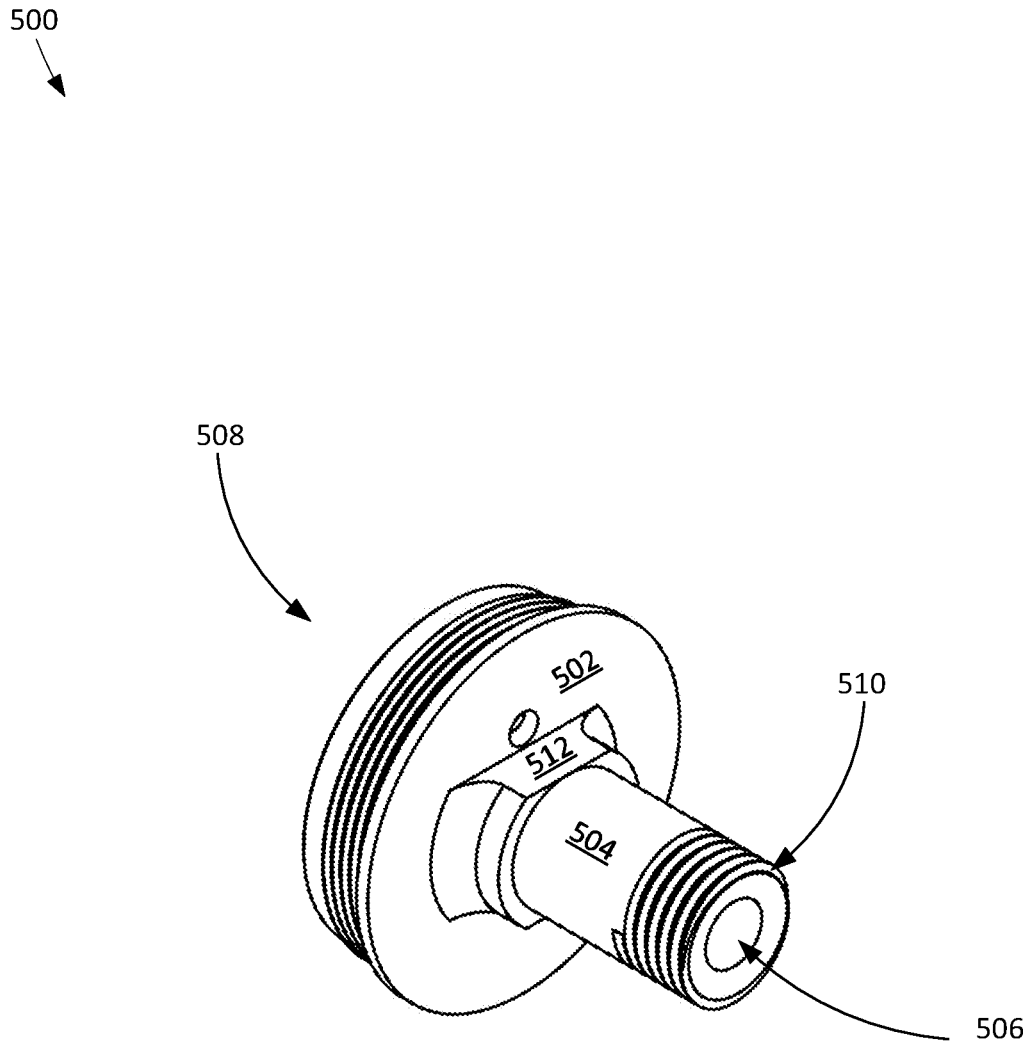
FIG. 5 is a perspective view diagram illustrating one embodiment of the alignment tube in accordance with embodiments of the present disclosure.

FIG. 5 is a perspective view diagram illustrating one embodiment of the alignment tube 500 in accordance with embodiments of the present disclosure. The alignment tube 500, in certain embodiments, is a generally tubular shape and may have differing diameters, as depicted. The alignment tube 500 is formed having a base 502 and a stem 504 extending outward from the base 502. A bore 506 extends through the base and the stem to form an opening in a proximate end 508 and the distal end 510 ("proximate" being closer to the muzzle end of the barrel). The outer surface of the alignment tube 500 may be threaded adjacent both ends of the alignment tube 500 for coupling to neighboring components of the suppressor 100.

In one embodiment, the alignment tube 500 couples to the baffle sleeve 204 at the proximate end 508, and to the end cap 212 at the distal end 510. The bore formed by the flow redirectors is continued by the bore 506 of the alignment tube 500. The baffle sleeve 204, in certain embodiments, includes a threaded internal surface (see FIG. 3) configured to engage the threaded external surface of the alignment tube 500. Wrench flats 512 allow for a user to tighten the alignment tube onto the baffle sleeve 204. In a further embodiment, the base 502 forms a barrier around which exhaust gasses must flow, which further slows down escaping gasses. In certain examples, the alignment tube 500 may be formed with an integrated flow redirector as will be discussed below with reference to at least FIG. 19.

Figure 6:
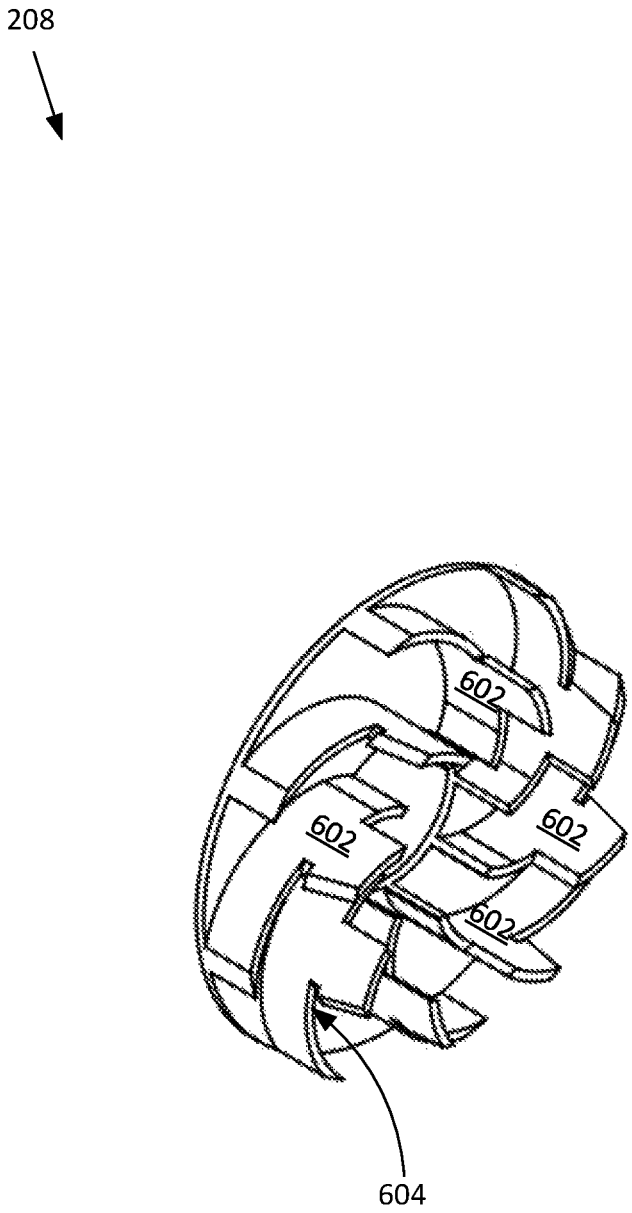
FIG. 6 is a perspective view diagram illustrating one embodiment of a first baffle disc in accordance with embodiments of the present disclosure.

FIG. 6 is a perspective view diagram illustrating one embodiment of a first baffle disc 208 in accordance with embodiments of the present disclosure. The first baffle disc 208 is configured with a central opening having a diameter selected to engage the stem of the alignment tube (see FIG. 5). The first baffle disc 208, in one embodiment, is disposed on the stem 504 adjacent the base 502 of the alignment tube 500. The outer diameter of the first baffle disc 208 is greater than that of the base 502 of the alignment tube 500. The vanes 602 are coupled to a base of the first baffle disc 208 and extend outward from the base, and are configured to direct gasses inward towards the center of the first baffle disc 208. A shoulder 604 may be formed in the vane 602 upon which a washer (e.g., blocking disc 214) may be disposed that blocks the flow of gasses and redirects the gasses inward (see FIG. 3). The vanes 602, if directing a fluid flow radially outward, are configured in counterclockwise flow direction; however, the fluid flow here is clockwise and inward.

Figure 7A:
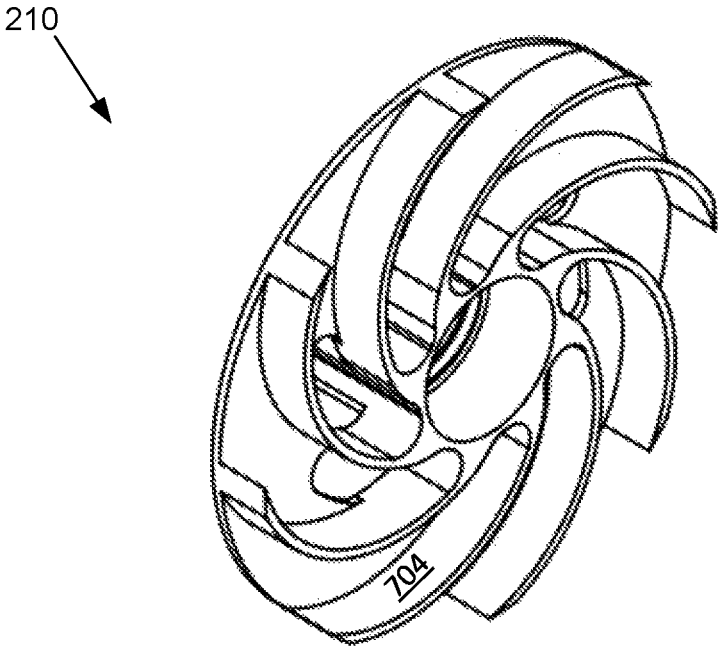
FIGS. 7*a* and 7*b* are perspective view diagrams illustrating embodiments of the second baffle disc in accordance with embodiments of the present disclosure.
Figure 7B:
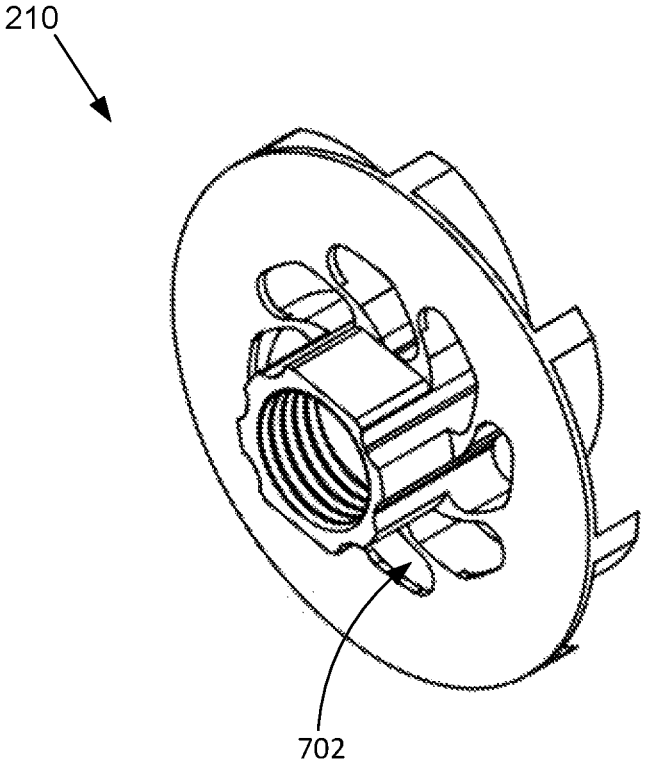

FIGS. 7*a* and 7*b* are perspective view diagrams illustrating embodiments of the second baffle disc 210 in accordance with embodiments of the present disclosure. The second baffle disc 210 is configured to thread onto the stem of the alignment tube at the distal end and secure the first baffle disc onto the stem between a base of the stem and the second baffle disc 210. The second baffle disc 210 is disposed adjacent the first baffle disc 208 and is configured to redirect exhaust gasses outward towards the outer tube 102 in a clockwise direction via vanes 704. However, it is contemplated that the direction of the gas flow may be reversed in any of the above described components. Openings 702 near the center of the second baffle disc 210 receive the gasses that were inwardly directed by the first baffle disc 208, and subsequently redirect the gasses outward in an opposite direction as the direction of the first baffle disc 208.

Figure 8:
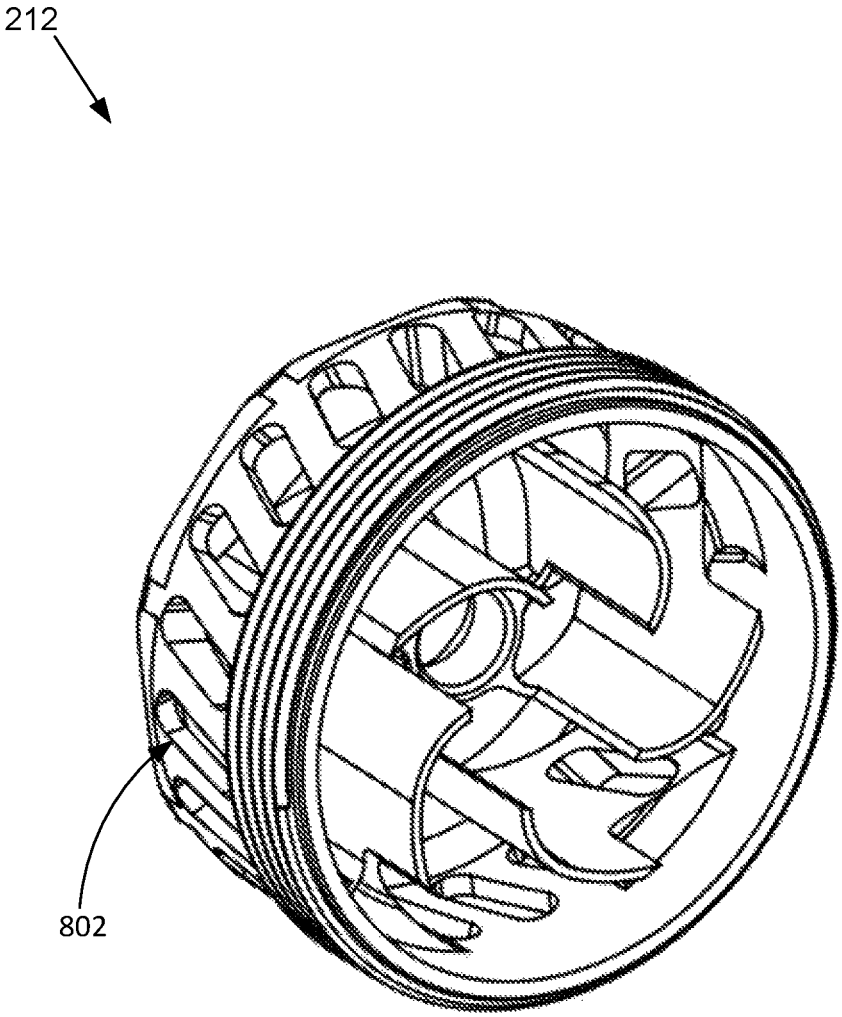
FIG. 8 is a perspective view diagram illustrating one embodiment of the end cap in accordance with embodiments of the present disclosure.

FIG. 8 is a perspective view diagram illustrating one embodiment of the end cap 212 in accordance with embodiments of the present disclosure. In certain embodiments, the end cap is disposed adjacent the second baffle disc 210 and is configured with vanes and openings for further redirection of the gasses. Openings 802 in the outer surface of the end cap 212 allow exhaust gasses and particulates to escape the outer tube 102. As will be described below, a chevron pattern in the outer tube 102 interrupts the openings 802 and further disturbs and inhibits the gas flow to slow and cool the gasses.

Figure 9:
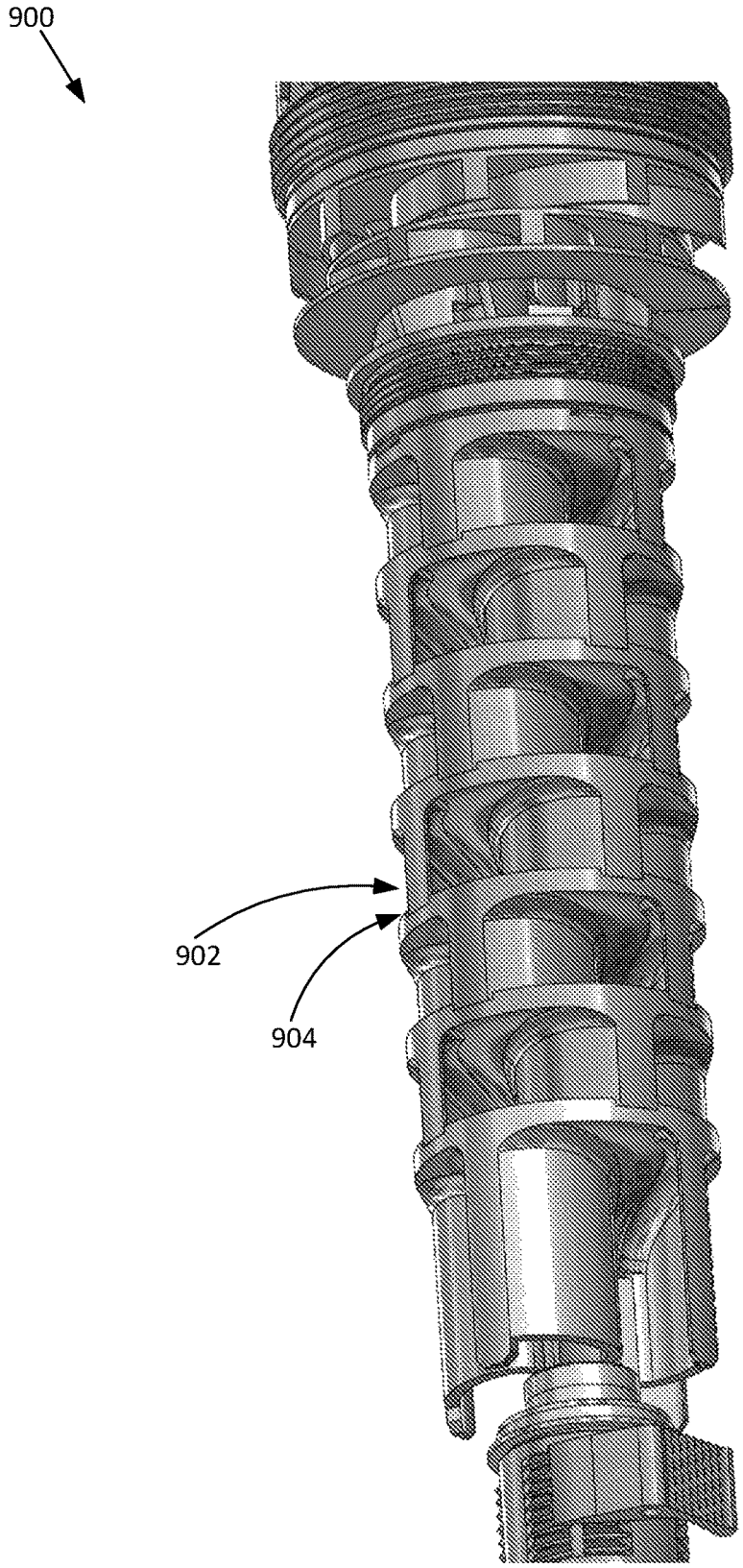
FIG. 9 is a perspective view diagram illustrating one embodiment of a partial segment view of the interior components of the suppressor in accordance with embodiments of the present disclosure.

FIG. 9 is a perspective view diagram illustrating one embodiment of a partial segment view of the interior components of the suppressor 100 in accordance with embodiments of the present disclosure. As described above, the fluid redirectors 202 are "stackable" or otherwise configured to nest into an adjacent fluid redirector 202. The generally conical shape of the top surface of the vanes of a fluid redirector 202 locate into the concave base of an adjacent fluid redirector, as depicted. In certain embodiments, the flow direction (e.g., clockwise or counterclockwise) may alternate from one fluid redirector 202 to the next redirector. In alternative examples, the flow direction may be the same direction, or alternate every third fluid redirector 202, for example. The vanes of the fluid redirector 202 include locating tabs 902 that nest into notches 904 formed in the base of an adjacent fluid redirector 202. This beneficially rotationally locks all of the fluid redirectors. The openings formed between the vanes exhaust gasses into the baffle sleeve 204 that surrounds the fluid redirectors 202.

Figure 10:
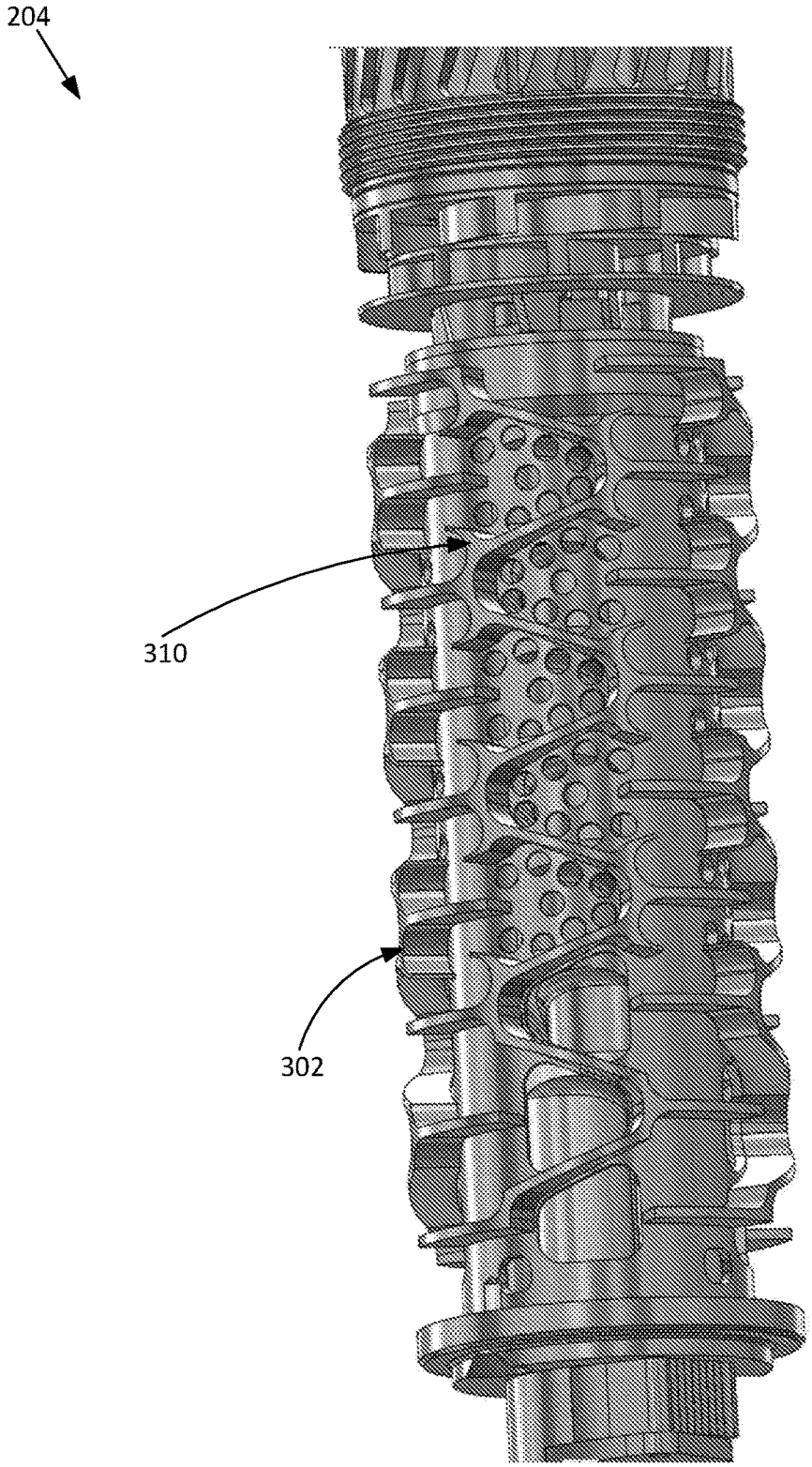
FIG. 10 is a perspective view diagram illustrating one embodiment of a partial segment view of the baffle sleeve and other interior components of the suppressor in accordance with embodiments of the present disclosure.

FIG. 10 is a perspective view diagram illustrating one embodiment of a partial segment view of the baffle sleeve 204 and other interior components of the suppressor 100 in accordance with embodiments of the present disclosure. The baffle sleeve 204, as described above, includes a plurality of baffles 302 or ridges that form a plurality of interdigitated pathways. Some of the ridges 302 may include hook-shaped formations 310 that cause the flow of a gas to reverse upon itself to slow and cause turbulent flow of the gasses.

Figure 11:
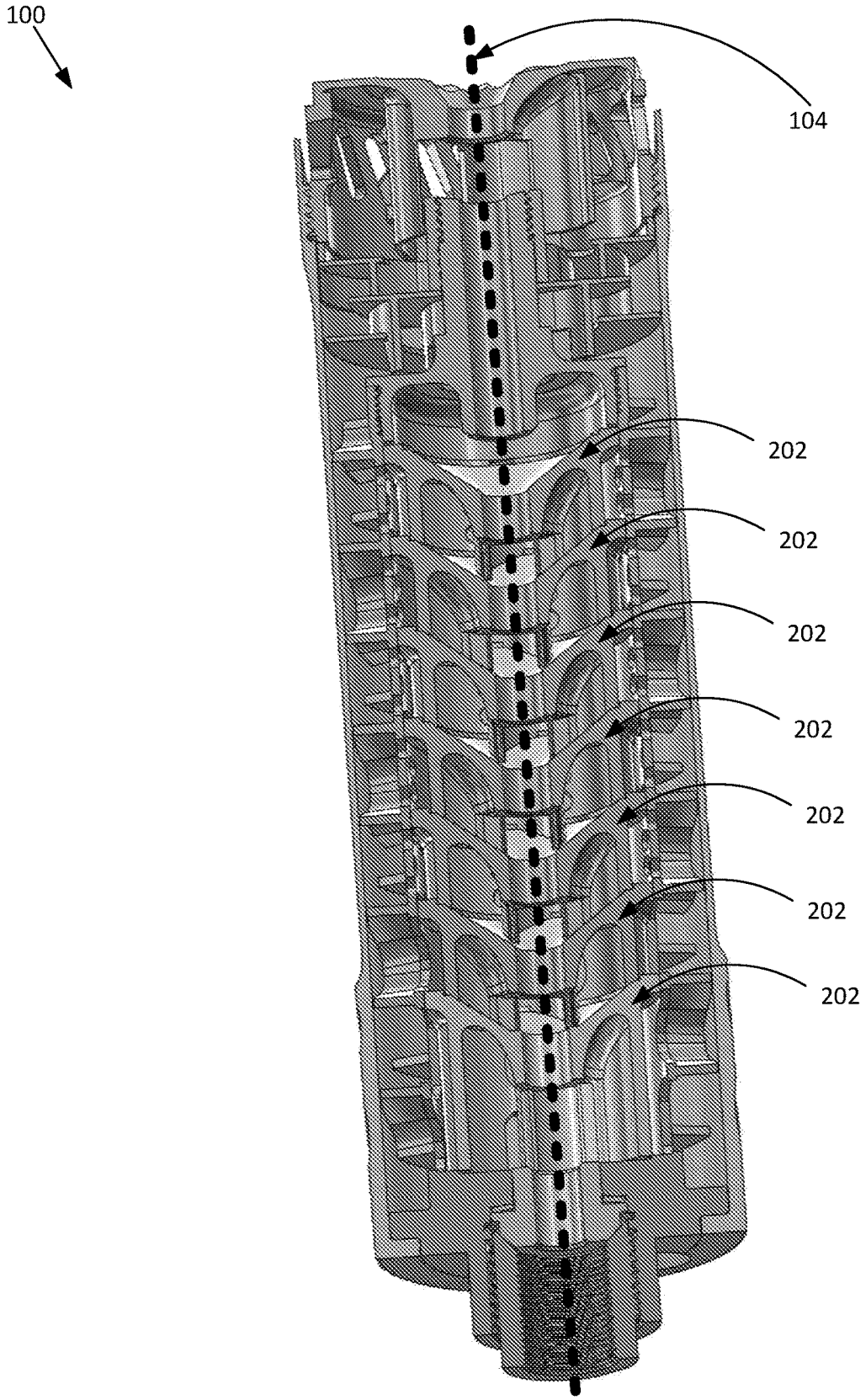
FIG. 11 is a perspective view diagram illustrating a cross-sectional view of the suppressor in accordance with embodiments of the present disclosure.

FIG. 11 is a perspective view diagram illustrating a cross-sectional view of the suppressor 100 in accordance with embodiments of the present disclosure. The depicted embodiment illustrates how the different components form the bore that defines the longitudinal axis 104 through which a projectile fired from the firearm passes. As the projectile passes each fluid redirector 202, gases expand into chambers formed by the vanes of the fluid redirectors and are spiraled outward (i.e., away from the bore) into openings in the baffle sleeve 204. As described above, the direction of the spiral flow alternates from one fluid redirector to another so that the force of the escaping gasses is balanced and does not affect the trajectory of the projectile.

Figure 12:
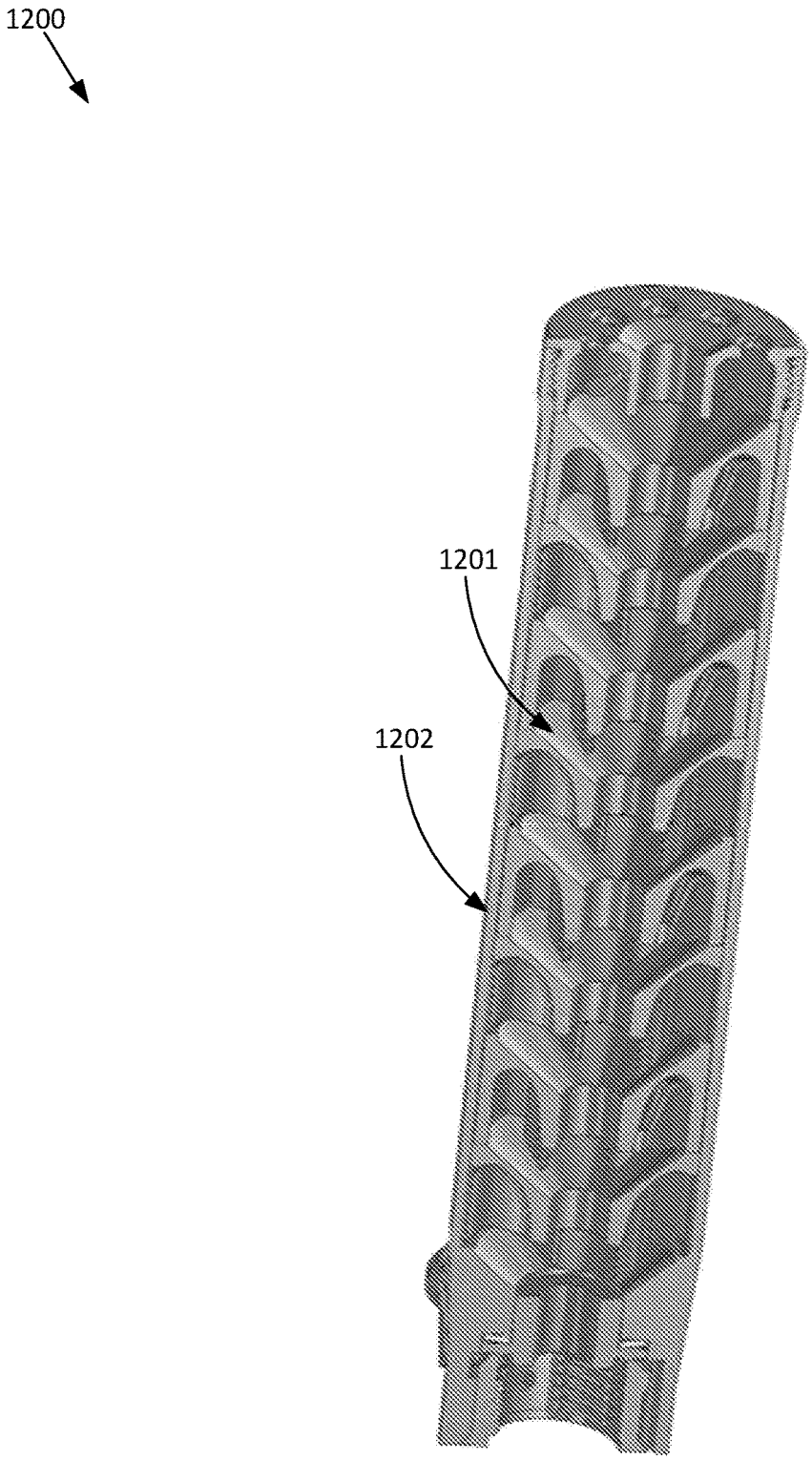
FIGS. 12 and 13 are perspective view diagrams illustrating a cross-sectional view of another embodiment of a suppressor in accordance with embodiments of the present disclosure.
Figure 13:
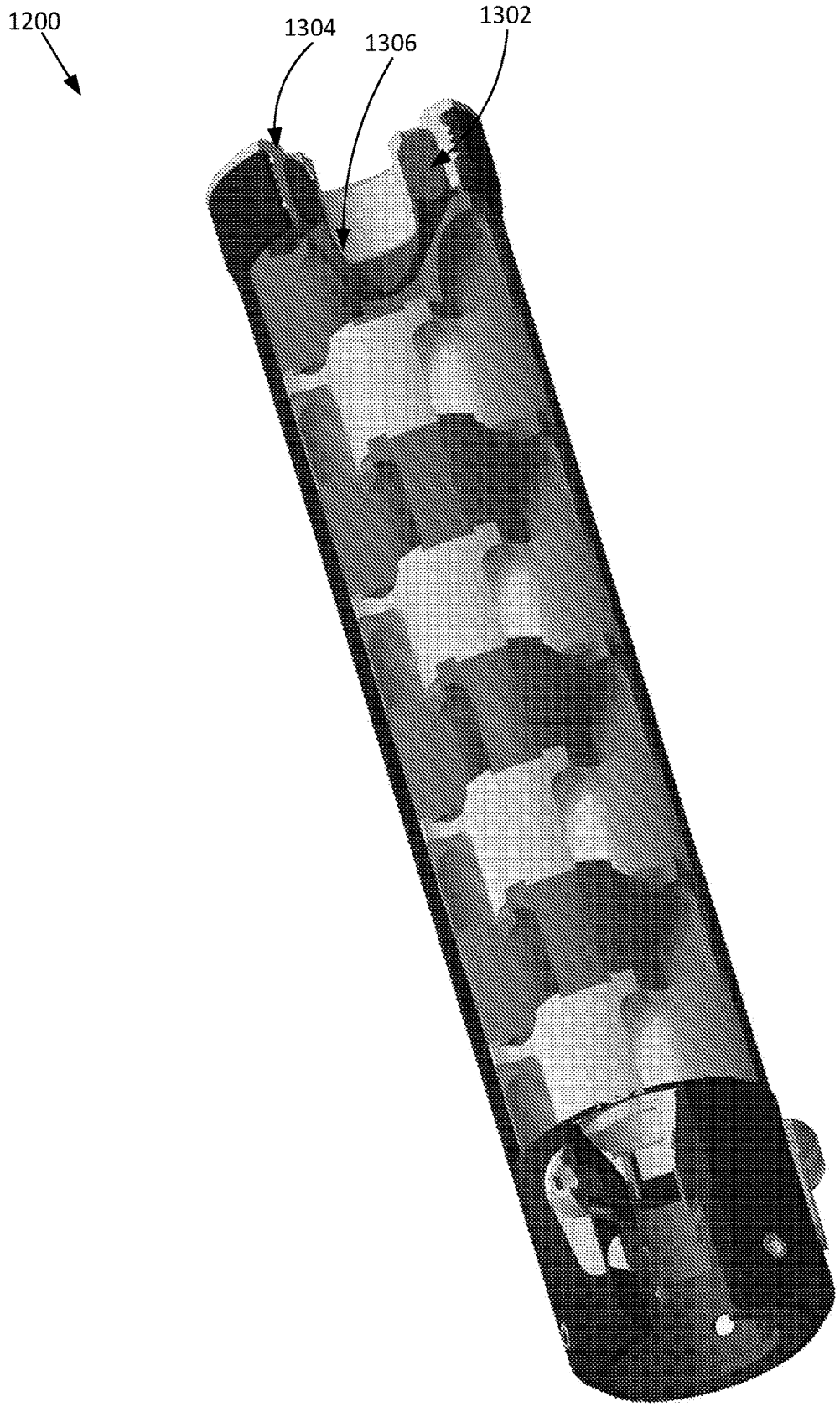

FIGS. 12 and 13 are perspective view diagrams illustrating a cross-sectional view of another embodiment of a suppressor 1200 in accordance with embodiments of the present disclosure. In certain embodiments, a smaller version of the suppressor 1200 may be provided that includes fluid redirectors without the baffle sleeve. Essentially, the fluid redirectors 1201 form an outer chamber with an outer tube 1202. In certain embodiments, the suppressor 1200 may have a pocket disposed adjacent an outlet of the suppressor 1200 for holding particulate capturing materials 1302. For example, the particulate capturing material may include a filter material for capturing the puff of white smoke that often accompanies the firing of a firearm.

In a further embodiment, a cap 1304 of the suppressor 1200 includes a collar for accepting a wipe cap 1306. The wipe cap 1306 may be a polymer cap with a perforation through which the projectile may travel. The wipe cap 1306 is replaceable and may be made of polypropylene or polyurethane. The wipe cap 1306 creates a seal to increase the resistance to the exhaust gasses and force them outward towards the outer tube which slows and cools the gasses.

Figure 14:
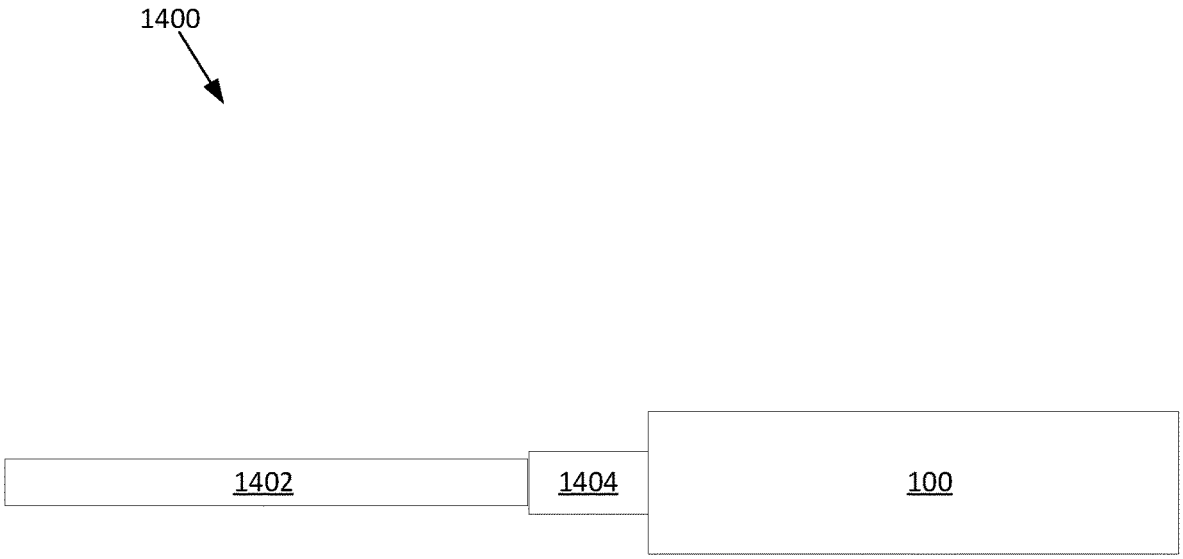
FIG. 14 is a schematic block diagram illustrating one embodiment of a system 1400 for coupling a barrel to a suppressor in accordance with embodiments of the present disclosure.

FIG. 14 is a schematic block diagram illustrating one embodiment of a system 1400 for coupling a barrel 1402 to a suppressor 100 in accordance with embodiments of the present disclosure. As described above, the barrel 1402 is formed having a bore through which a projectile may pass. A quick-disconnect barrel adapter 1404 is coupled to the barrel 1402, which may be threaded. In alternative embodiments, the barrel adapter 1404 may use set screws or other fasteners to couple the barrel adapter 1404 to the barrel. The barrel adapter 1404 may include an interrupted thread which corresponds to an interrupted thread formed in the suppressor 100.

Figure 15:
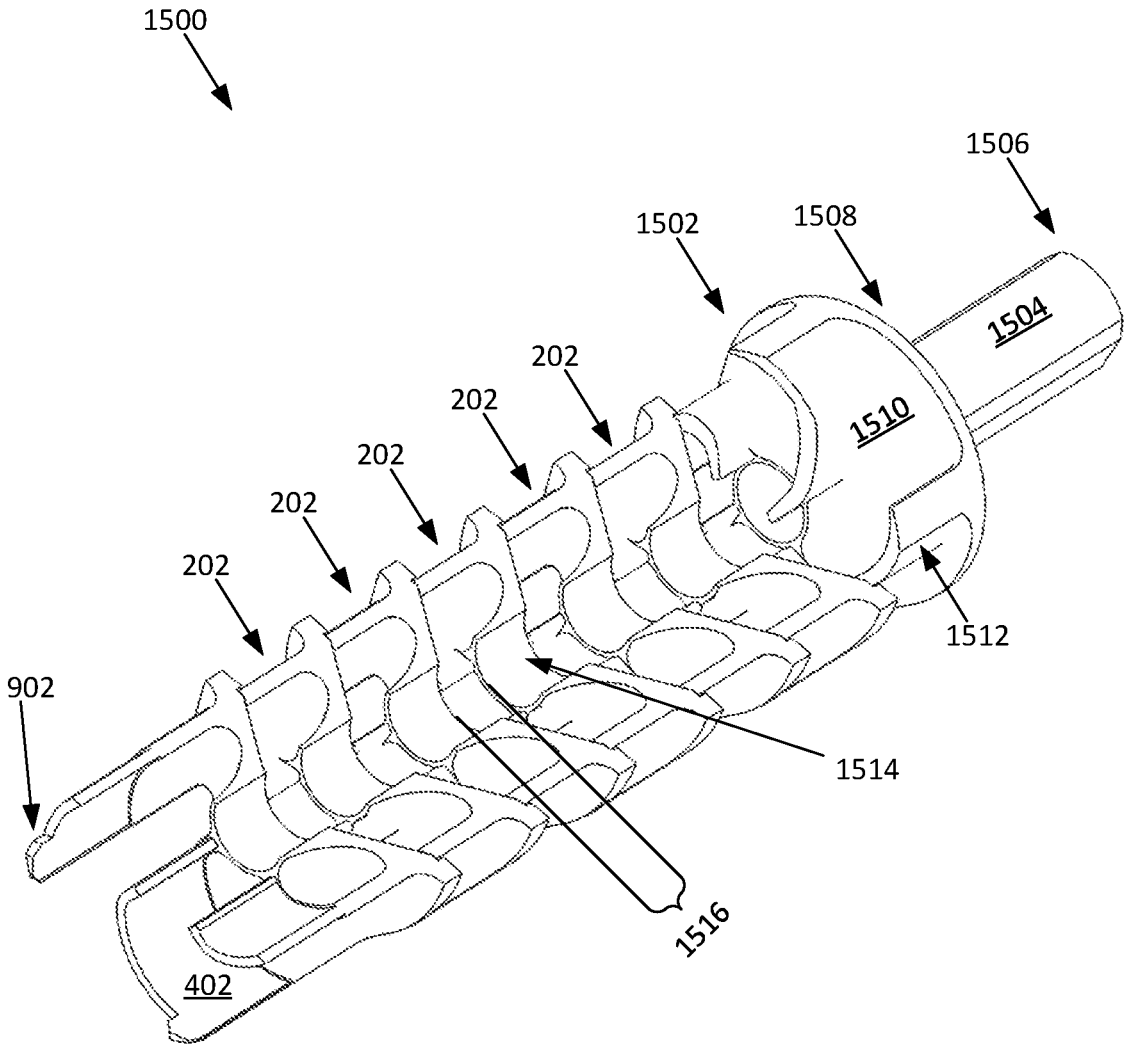
FIG. 15 is a partial section view illustrating another example of a stack 1500 of flow redirector in accordance with examples of the subject disclosure.

FIG. 15 is a partial section view illustrating another example of a stack 1500 of flow redirector 202 in accordance with examples of the subject disclosure. The stack 1500 of flow redirectors 202, as described above, may be configured with vanes 402 that direct fluid in the same direction. Alternatively, any combination of clockwise and counterclockwise directed vanes 402 may be used. Extending outward from the vanes is a locating tab 902. The locating tab 902 is configured to nest into a notch formed in the base of an adjacent flow redirector 202.

In certain examples, the alignment tube 1502 may be integrally formed with a flow redirector. As depicted, the alignment tube 1502 is formed of a shaft 1504 having first 1506 and second 1508 ends. Adjacent the second end 1508 is an integrally formed flow redirector 1510. The flow redirector 1510 is similar in configuration to the flow redirector 202 of FIG. 2. The flow redirector 1510 is formed with a substantially annular base that extends outward radially from the shaft 1504. Extending longitudinally (i.e., along a longitudinal axis defined by the bore) are vanes 1512. Each vane 1512 extends in a curved path from the bore to the perimeter of the base. The vanes 1512, in certain examples, extend longitudinally away from the base a distance that is greater than the shroud 1514 center so that a gap 1516 is formed between adjacent flow redirectors. This beneficially allows for the passage of exhaust gasses from the bore to pathways formed by the vanes 1512.

Figure 16:
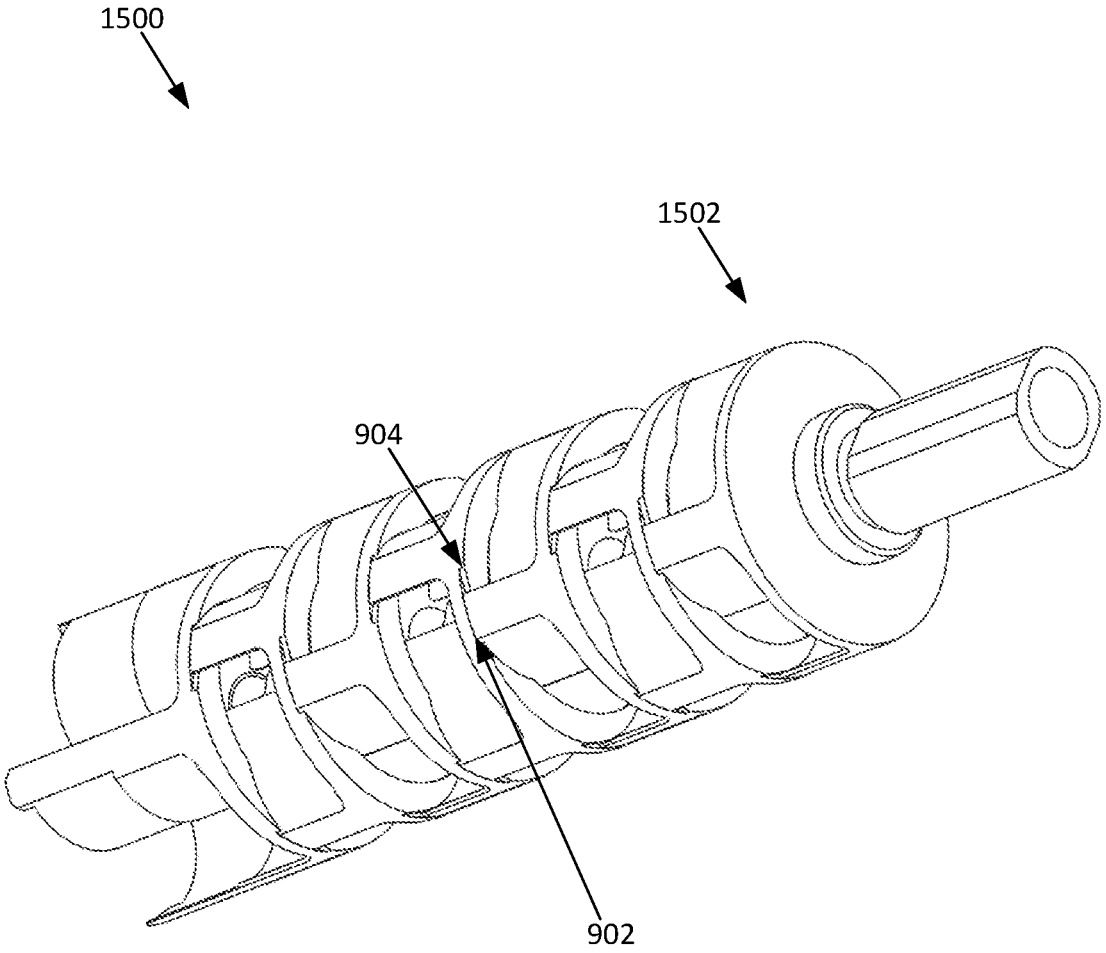
FIG. 16 is a perspective view diagram of the stack, according to examples of the subject disclosure.

FIG. 16 is a perspective view diagram of the stack 1500, according to examples of the subject disclosure. The depicted embodiment illustrates how flow redirectors 202 may be stacked with the alignment tube 1502. The locating tabs 902 are configured to nest into notches 904 of an adjacent flow redirector 202 to rotationally index the flow redirectors 202.

Figure 17:
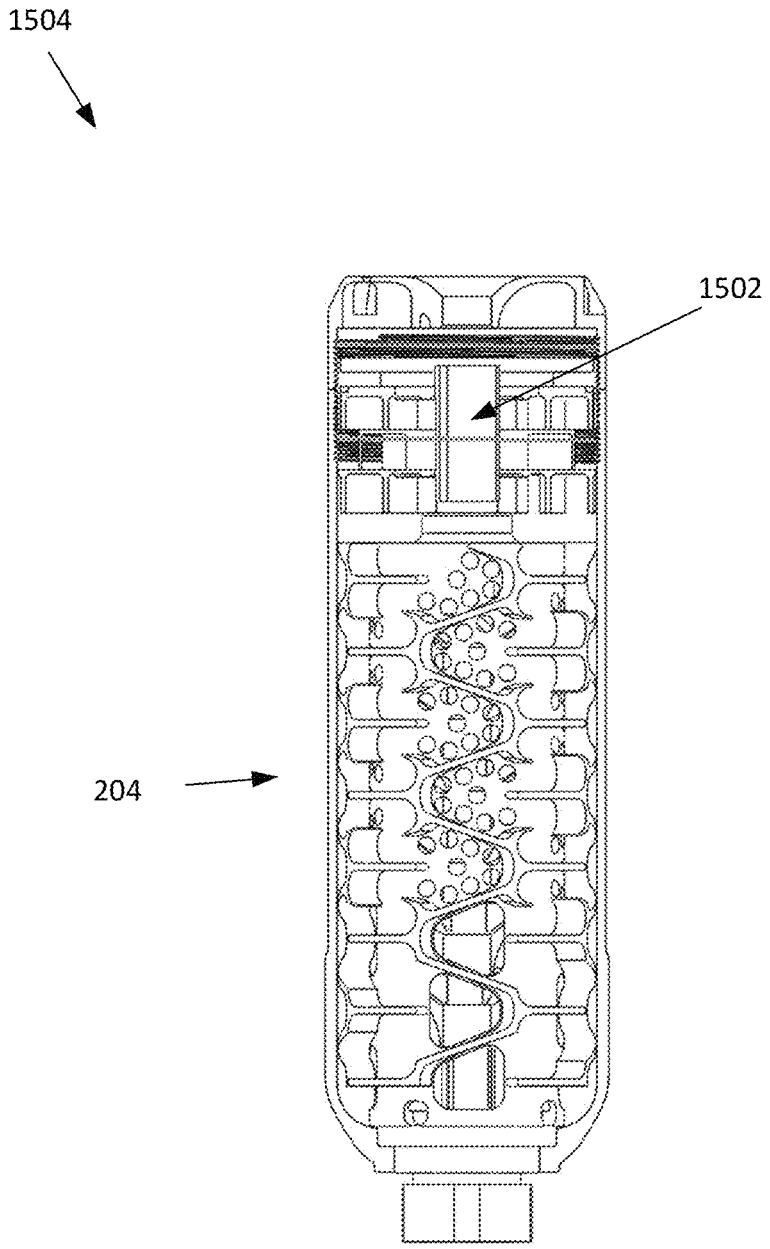
FIG. 17 is a side view diagram illustrating a partial cross section of the firearm suppressor, according to examples of the subject disclosure.

FIG. 17 is a side view diagram illustrating a partial cross section of the firearm suppressor 1700, according to examples of the subject disclosure. In the depicted embodiment, the baffle sleeve 204 is configured, as described above, with interdigitated baffles. Opening disposed in the baffle sleeve 204 allow exhaust gasses to flow back and forth from the fluid redirectors, which are disposed within the baffle sleeve 204.

Figure 18:
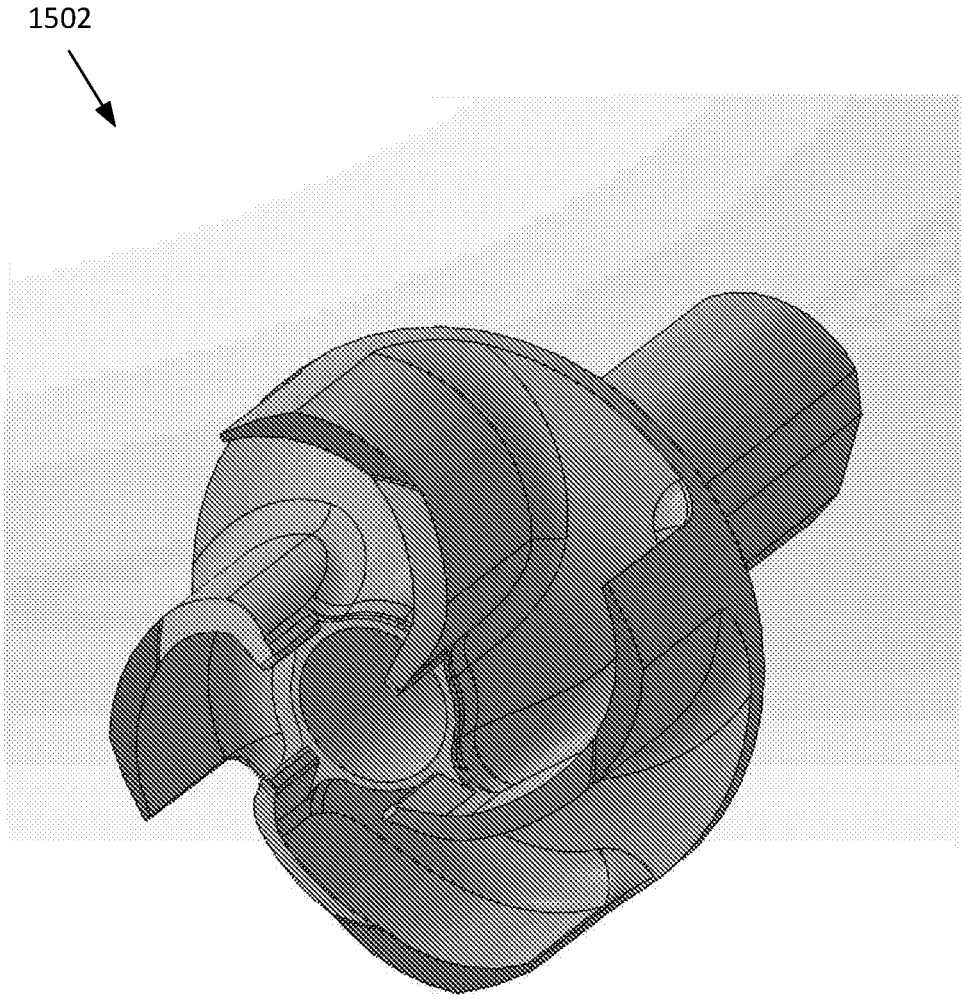
FIGS. 18-20 are perspective view diagrams illustrating embodiments of the alignment tube and flow redirectors, according to examples of the subject disclosure.
Figure 19:
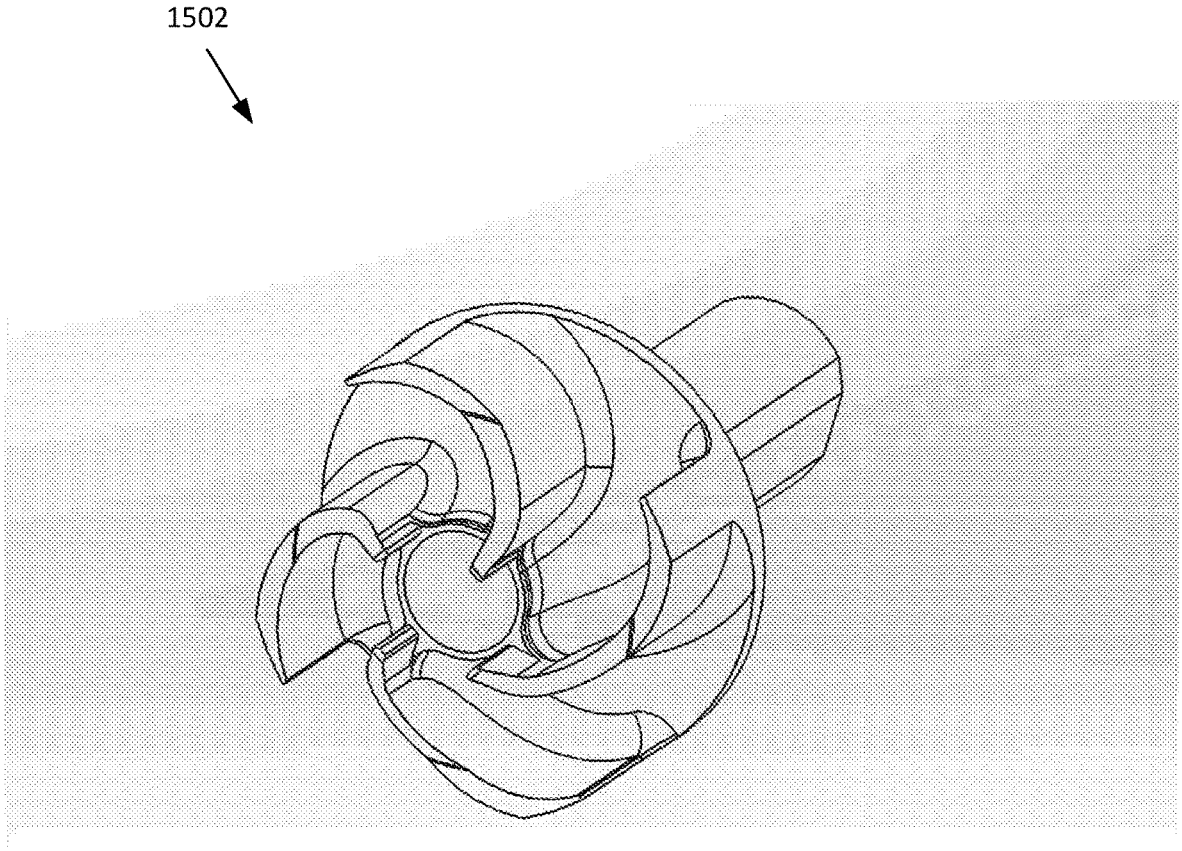
Figure 20:
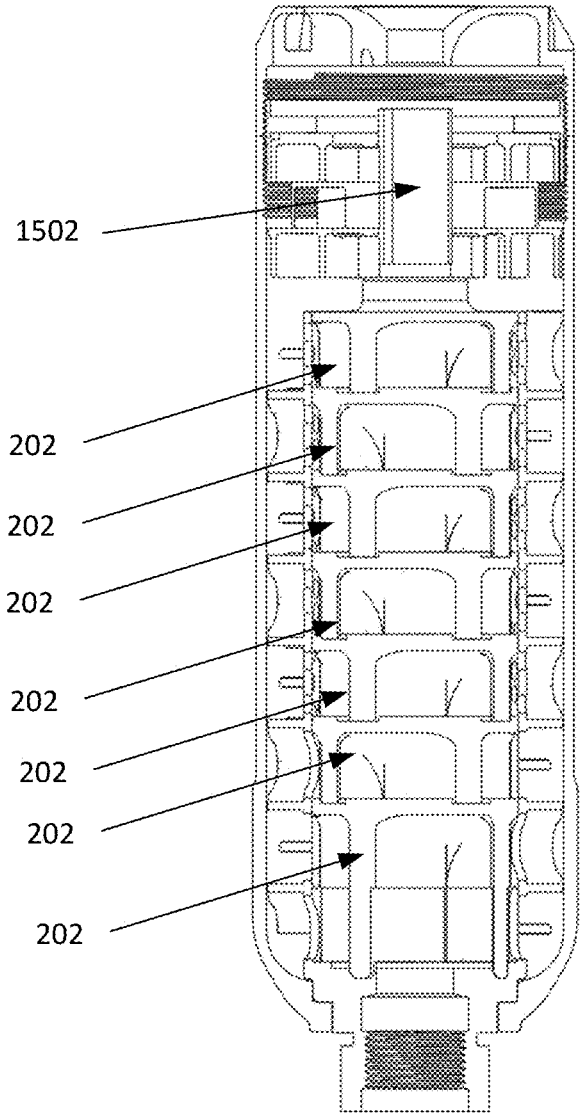

FIGS. 18-20 are perspective view diagrams illustrating embodiments of the alignment tube 1502 and flow redirectors, according to examples of the subject disclosure. As discussed above with reference to FIG. 15, the alignment tube 1502 is formed with an integrated fluid redirector having vanes extending therefrom. The vanes form fluid pathways, that when nested into the base of an adjacent fluid redirector, are closed on four sides to redirect exhaust gasses away from the bore. Beneficially, the alignment tube 1502 allows for the easy assembly of the firearm suppressor. For example, multiple fluid redirectors may be inserted into an outer tube without needing to align each fluid redirector. Using the alignment tube 1502, a user turns the alignment tube 1502 in a clockwise or counterclockwise direction. This causes the locating tabs 902 of one fluid redirector to find and nest into the notch of the adjacent fluid redirector. The user may hear the clicking of the fluid redirectors as each one falls into the notches of the adjacent fluid redirector. Once all fluid redirectors are nested, baffle discs and end caps may be positioned and fastened to the outer tube.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

Furthermore, the described features, advantages, and characteristics of the subject matter of the present disclosure may be combined in any suitable manner in one or more embodiments. One skilled in the relevant art will recognize that the subject matter may be practiced without one or more of the specific features or advantages of a particular embodiment. In other instances, additional features and advantages may be recognized in certain embodiments that may not be present in all embodiments. These features and advantages will become more fully apparent from the following description and appended claims or may be learned by the practice of the subject matter as set forth hereinafter.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A firearm suppressor comprising:

a plurality of fluid redirectors, each of the plurality of fluid redirectors comprising vanes configured to direct a fluid flow in one of either a clockwise or counterclockwise direction, where the plurality of fluid redirectors comprises at least one fluid redirector configured to direct the fluid flow in a clockwise direction, and at least one fluid redirector configured to direct the fluid flow in a counterclockwise direction; and an outer tube disposed around the plurality of fluid redirectors that is configured to define at least one chamber between at least one of the plurality of fluid redirectors and the outer tube to allows fluid flow between the at least one of the plurality of fluid redirectors and an adjacent fluid redirector, and where the rotational position of at least one of the plurality of fluid redirectors is fixed with respect to the outer tube, and where each of the plurality of fluid redirectors comprises:

an annular base that tapers to an opening in a center of the annular base, the annular base forming a substantially conical shape;

a locating tab extending from at least one of the vanes; and at least one positioning notch formed in the annular base and configured to receive a locating tab of an adjacent fluid redirector.

2. The firearm suppressor of claim 1, further comprising a baffle sleeve disposed between the outer tube and the plurality of fluid redirectors.

3. The firearm suppressor of claim 2, where the baffle sleeve comprises at least one uninterrupted fluid pathway extending along an exterior surface of the baffle sleeve and formed by interdigitated baffle ridges.

4. The firearm suppressor of claim 1, where the vanes of each of the plurality of fluid redirectors are configured to nest into the opening of the annular base of the adjacent one of the plurality of fluid redirectors.

5. The firearm suppressor of claim 1, further comprising an alignment tube comprising:

a tubular shaft having a first end and a second end; and at least one fluid redirector, of the plurality of fluid redirectors, integrally formed with the tubular shaft disposed adjacent the first end.

6. The firearm suppressor of claim 5, where the at least one fluid redirector comprises:

an annular base that tapers to an opening in a center of the annular base, the annular base forming a substantially conical shape, and where the opening extends from the annular base to the second end of the tubular shaft; and a locating tab extending from at least one of the vanes.

7. The firearm suppressor of claim 1, further comprising a baffle disc slidably coupled to a tubular shaft of an alignment tube.

8. The firearm suppressor of claim 7, where the baffle disc comprises:

a central opening configured to engage the tubular shaft of the alignment tube; and a plurality of vanes extending outward from the baffle disc.

9. The firearm suppressor of claim 8, where each of the plurality of vanes of the baffle disc includes a shoulder for receiving and locating a washer.

10. A stackable fluid redirector for a firearm suppressor, the stackable fluid redirector comprising:

an annular base that tapers to a central opening, where the central opening is configured to receive a projectile; and at least one vane extending outward from the annular base and configured to nest into an annular base of a first adjacent stackable fluid redirector, where the at least one vane is configured to direct a fluid flow in one of either a clockwise or a counterclockwise direction that is opposite a direction of the first adjacent stackable fluid redirector.

11. The stackable fluid redirector of claim 10, where the at least one vane comprises a locating tab extending outward from the at least one vane.

12. The stackable fluid redirector of claim 11, where the annular base comprises at least one positioning notch configured to receive the locating tab of a second adjacent stackable fluid redirector.

13. The stackable fluid redirector of claim 10, further comprising an outer tube configured to receive a plurality of stackable fluid redirectors.

14. The stackable fluid redirector of claim 13, where the outer tube is configured to couple to a muzzle of a firearm.

15. The stackable fluid redirector of claim 13, further comprising a baffle sleeve disposed between the outer tube and the plurality of stackable fluid redirectors.

16. The stackable fluid redirector of claim 15, where the baffle sleeve comprises at least one uninterrupted fluid pathway extending along an exterior surface of the baffle sleeve and formed by interdigitated baffle ridges.

17. The stackable fluid redirector of claim 15, further comprising a baffle disc slidably coupled to a tubular shaft of an alignment tube.

18. The stackable fluid redirector of claim 17, where the baffle disc comprises:

a central opening configured to engage the tubular shaft of the alignment tube; and a plurality of vanes extending outward from the baffle disc.

19. A firearm comprising:

a barrel;

a firearm suppressor coupled to the barrel, where the firearm suppressor comprises:

a plurality of fluid redirectors, each of the plurality of fluid redirectors comprising vanes configured to direct a fluid flow in one of either a clockwise or counterclockwise direction, and where the plurality of fluid redirectors comprises at least one fluid redirector configured to direct the fluid flow in a clockwise direction along a radial pathway, and at least one fluid redirector configured to direct the fluid flow in a counterclockwise direction along a radial pathway; and an outer tube disposed around the plurality of fluid redirectors that is configured to define at least one chamber between at least one of the plurality of fluid redirectors and the outer tube to allows fluid flow between the at least one of the plurality of fluid redirectors and an adjacent fluid redirector, and where the rotational position of at least one of the plurality of fluid redirectors is fixed with respect to the outer tube, and where each of the plurality of fluid redirectors comprises:

an annular base that tapers to an opening in a center of the annular base, the annular base forming a substantially conical shape;

a locating tab extending from at least one of the vanes; and at least one positioning notch formed in the annular base and configured to receive a locating tab of an adjacent fluid redirector.

* * * * *